US009499875B2

(12) United States Patent
Takahashi

(10) Patent No.: US 9,499,875 B2
(45) Date of Patent: Nov. 22, 2016

(54) CONTINUOUS ANNEALING DEVICE AND CONTINUOUS HOT-DIP GALVANISING DEVICE FOR STEEL STRIP

(71) Applicant: JFE STEEL CORPORATION, Chiyoda-ku, Tokyo (JP)

(72) Inventor: Hideyuki Takahashi, Fukuyama (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 0 days.

(21) Appl. No.: 14/761,719

(22) PCT Filed: Feb. 18, 2014

(86) PCT No.: PCT/JP2014/000825
§ 371 (c)(1),
(2) Date: Jul. 17, 2015

(87) PCT Pub. No.: WO2014/129177
PCT Pub. Date: Aug. 28, 2014

(65) Prior Publication Data

US 2015/0361520 A1 Dec. 17, 2015

(30) Foreign Application Priority Data

Feb. 25, 2013 (JP) ..... 2013-035094

(51) Int. Cl.
*C21D 9/573* (2006.01)
*C22C 38/06* (2006.01)
(Continued)

(52) U.S. Cl.
CPC ..... *C21D 9/573* (2013.01); *B05C 3/02* (2013.01); *C21D 1/74* (2013.01); *C21D 1/76* (2013.01);
(Continued)

(58) Field of Classification Search
None
See application file for complete search history.

(56) References Cited

U.S. PATENT DOCUMENTS 4,183,983 A 1/1980 Cook et al.
4,415,382 A * 11/1983 Gaskey ..... C21D 9/573 148/661
(Continued)

FOREIGN PATENT DOCUMENTS

JP S59-133329 A 7/1984
JP H01-96333 A 4/1989
(Continued)

OTHER PUBLICATIONS

Apr. 1, 2014 International Search Report issued in International Patent Application No. PCT/JP2014/000825.
(Continued)

*Primary Examiner* — Dah-Wei D Yuan
*Assistant Examiner* — Jethro M Pence
(74) *Attorney, Agent, or Firm* — Kenja IP Law PC

(57) ABSTRACT

A large continuous annealing device that anneals a steel strip by multiple passes in a vertical annealing furnace and is capable of quickly switching the atmosphere in the furnace is provided. A steel strip continuous annealing device 100 has a vertical annealing furnace 10 in which a heating zone 14, a soaking zone 16, and a cooling zone 18 are arranged in this order, and anneals a steel strip P passing through the zones 14, 16, and 18 in the order while being conveyed in the vertical direction in the vertical annealing furnace 10. Adjacent zones communicate through a communicating portion 30 or 32 connecting upper parts or lower parts of the zones. A gas delivery port 38 is provided in each zone, in the position opposite in the vertical direction to the position of
(Continued)

the communicating portion with the immediately preceding zone in the steel strip P passing order.

9 Claims, 6 Drawing Sheets

(51) Int. Cl.

| | |
|---|---|
| ***C23C 2/40*** | (2006.01) |
| ***B05C 3/02*** | (2006.01) |
| ***C21D 1/74*** | (2006.01) |
| ***C23C 2/02*** | (2006.01) |
| ***C23C 2/06*** | (2006.01) |
| ***C21D 9/56*** | (2006.01) |
| ***C21D 1/76*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C23C 2/00*** | (2006.01) |
| ***F27B 9/14*** | (2006.01) |
| *F27D 7/06* | (2006.01) |

(52) U.S. Cl.

CPC ..... *C21D 9/005* (2013.01); *C21D 9/56* (2013.01); *C21D 9/5735* (2013.01); *C22C 38/002* (2013.01); *C22C 38/02* (2013.01); *C22C 38/04* (2013.01); *C22C 38/06* (2013.01); *C23C 2/003* (2013.01); *C23C 2/02* (2013.01); *C23C 2/06* (2013.01); *C23C 2/40* (2013.01); *F27B 9/145* (2013.01); *F27D 2007/063* (2013.01)

(56) References Cited

U.S. PATENT DOCUMENTS

| | | | |
|---|---|---|---|
| 2009/0123651 | A1 | 5/2009 | Okada |
| 2013/0273251 | A1 | 10/2013 | Takahashi et al. |

FOREIGN PATENT DOCUMENTS

| | | | |
|---|---|---|---|
| JP | H08-109417 | A | 4/1996 |
| JP | H09-324209 | A | 12/1997 |
| JP | 2002-003953 | A | 1/2002 |
| JP | 2004-018967 | A | 1/2004 |
| JP | 2005-060738 | A | 3/2005 |
| JP | 2012-126983 | A | 7/2012 |
| WO | 2007/043273 | A1 | 4/2007 |

OTHER PUBLICATIONS

Jan. 28, 2014 Office Action issued by JPO for the corresponding Japanese Patent Application No. 2013-035094.

Jun. 21, 2016, Office Action issued by the State Intellectual Property Office in the corresponding Chinese Patent Application No. 201480010160.2 with English language search report.

Feb. 16, 2016, Extended European Search Report issued by the European Patent Office in the corresponding European Patent Application No. 14753654.4.

* cited by examiner

CONTINUOUS ANNEALING DEVICE AND CONTINUOUS HOT-DIP GALVANISING DEVICE FOR STEEL STRIP

TECHNICAL FIELD

The disclosure relates to a steel strip continuous annealing device and a continuous hot-dip galvanising device.

BACKGROUND

As a steel strip continuous annealing device, a large continuous annealing device that anneals a steel strip by multiple passes in a vertical annealing furnace in which a preheating zone, a heating zone, a soaking zone, and a cooling zone are arranged in this order is typically used.

The following conventional method is widely employed in the continuous annealing device in order to reduce water content or oxygen concentration in the furnace, for example upon startup after opening the furnace to the air or in the case where the air enters into the atmosphere in the furnace. The temperature in the furnace is increased to vaporize water in the furnace. Around the same time, non-oxidizing gas such as inert gas is delivered into the furnace as furnace atmosphere replacement gas, and simultaneously the gas in the furnace is discharged, thus replacing the atmosphere in the furnace with the non-oxidizing gas.

However, the conventional method is problematic in that it causes a significant decline in productivity, as lowering the water content or oxygen concentration in the atmosphere in the furnace to a predetermined level suitable for normal operation takes a long time and the device cannot be operated during the time. Note that the atmosphere in the furnace can be evaluated by measuring the dew point of the gas in the furnace. For example, the gas has a low dew point such as less than or equal to −30° C. (e.g. about −60° C.) when it mainly contains non-oxidizing gas, but has a higher dew point such as exceeding −30° C. when it contains more oxygen or water vapor.

In recent years, the demand for high tensile strength steel (high tensile strength material) which contributes to more lightweight structures and the like is increasing in the fields of automobiles, household appliances, building products, etc. The high tensile strength technology has a possibility that a high tensile strength steel strip with good hole expansion formability can be manufactured by adding Si into the steel, and also has a possibility that a steel strip with good ductility where retained austenite (γ) is easily formed can be manufactured by adding Si or Al.

When a high strength cold-rolled steel strip contains an oxidizable element such as Si or Mn, however, the oxidizable element is concentrated on the surface of the steel strip during annealing to form an oxide film of Si or Mn, which leads to problems such as poor appearance and poor chemical convertibility in phosphatization and the like.

Especially in the case of a hot-dip galvanised steel strip, the following problems arise when the steel strip contains an oxidizable element such as Si or Mn: the oxide film formed on the surface of the steel strip impairs the coating property and causes an uncoating defect, or lowers the alloying speed in alloying treatment after galvanisation. Regarding Si, in particular, when an oxide film of $SiO_2$ is formed on the surface of the steel strip, the wettability between the steel strip and the molten metal decreases significantly, and also the $SiO_2$ film constitutes a barrier to mutual diffusion of the steel substrate and the galvanising metal in the alloying treatment, thus impairing the coating property and the alloying property.

This problem may be avoided by a method of controlling the oxygen potential in the annealing atmosphere. As a method of increasing the oxygen potential, for example, WO 2007/043273 A1 (Patent Literature (PTL) 1) describes a method of regulating the dew point from the latter heating zone to the soaking zone to a high dew point greater than or equal to −30° C.

CITATION LIST

Patent Literature

PTL 1: WO 2007/043273 A1

SUMMARY

Technical Problem

The technique in PTL 1 has the feature that the gas in the furnace is set to a high dew point in the specific part in the vertical annealing furnace. This is, however, merely a less desirable alternative. In theory, it is preferable to minimize the oxygen potential in the annealing atmosphere in order to suppress the formation of the oxide film on the surface of the steel strip, as described in PTL 1.

However, given that Si, Mn, or the like is easily oxidizable, it is considered very difficult to stably obtain, in such a large continuous annealing device that is installed in a continuous galvanising line (CGL) or a continuous annealing line (CAL), an atmosphere of a low dew point less than or equal to −40° C. where the oxidation of Si, Mn, or the like can be sufficiently suppressed.

We have conceived that, since the gas introduced into the vertical annealing furnace is non-oxidizing gas having a low dew point, the low dew point atmosphere may be stably obtained by quickly switching the atmosphere in the furnace.

Quickly switching the atmosphere in the furnace in a large annealing device is important not only for lowering the dew point. In this respect, none of the conventional continuous annealing devices including that in PTL 1 is capable of quickly switching the atmosphere in the furnace.

It could therefore be helpful to provide a large continuous annealing device that anneals a steel strip by multiple passes in a vertical annealing furnace and is capable of quickly switching the atmosphere in the furnace, and a continuous hot-dip galvanising device including the continuous annealing device.

Solution to Problem

We measured the dew point distribution in a large vertical annealing furnace, and conducted flow analysis and the like based on the measurement. As a result, we discovered that the atmosphere in the furnace can be effectively replaced by providing a gas delivery port in each zone of the vertical annealing furnace in such a position that satisfies a predetermined condition in its relationship with the position of a communicating portion through which adjacent zones communicate.

The disclosure is based on the aforementioned discoveries. We thus provide the following.

(1) A steel strip continuous annealing device that has a vertical annealing furnace in which a heating zone, a soaking zone, and a cooling zone are arranged in the stated order, and anneals a steel strip passing through the zones in the order while being conveyed in a vertical direction in the vertical annealing furnace, wherein adjacent zones communicate with each other through a communicating portion that connects upper parts or lower parts of the respective zones, a gas delivery port is provided in each of the heating zone, the soaking zone, and the cooling zone, and the gas delivery port in the heating zone is provided in an upper part of the heating zone, and the gas delivery port in each of the soaking zone and the cooling zone is provided in a position opposite in the vertical direction to a position of a communicating portion with an immediately preceding zone in the order in which the steel strip passes through.

(2) The steel strip continuous annealing device according to the foregoing (1), wherein a communicating portion between the heating zone and the soaking zone connects lower parts of the respective zones, and a communicating portion between the soaking zone and the cooling zone connects upper parts of the respective zones.

(3) The steel strip continuous annealing device according to the foregoing (1) or (2), wherein a preheating zone provided with a gas delivery port in an upper part is arranged upstream of the heating zone, and the preheating zone and the heating zone communicate with each other through a communicating portion that connects upper parts or lower parts of the respective zones, and the gas delivery port in the heating zone is provided in a position opposite in the vertical direction to a position of the communicating portion with the preheating zone, instead of in the upper part of the heating zone.

(4) The steel strip continuous annealing device according to the foregoing (3), wherein the communicating portion between the preheating zone and the heating zone connects the lower parts of the respective zones.

(5) The steel strip continuous annealing device according to any one of the foregoing (1) to (4), wherein a gas discharge port is provided in a part or all of the zones, in a position opposite in the vertical direction to a position of the gas delivery port.

(6) The steel strip continuous annealing device according to any one of the foregoing (1) to (5), wherein a length of each of the zones is 7 m or less.

(7) The steel strip continuous annealing device according to any one of the foregoing (1) to (6), wherein an atmosphere separation portion for separating atmospheres in adjacent zones from each other is provided in each communicating portion.

(8) The steel strip continuous annealing device according to any one of the foregoing (1) to (7), wherein a flow rate Q ($m^3$/hr) per gas delivery port in each zone satisfies conditions of Expression (1) and Expression (2)

$$Q>2.62\times V \quad \text{Expression (1)}$$

$$Q>0.87\times V_0 \quad \text{Expression (2)}$$

where $V_0$ ($m^3$) is a volume of the zone, and V ($m^3$) is a volume of the zone per gas delivery port.

(9) A continuous hot-dip galvanising device including: the steel strip continuous annealing device according to any one of the foregoing (1) to (8); and a hot-dip galvanising device that hot-dip galvanises the steel strip discharged from the cooling zone.

Advantageous Effect

The disclosed steel strip continuous annealing device and continuous hot-dip galvanising device are capable of quickly switching the atmosphere in the furnace. Accordingly, the dew point of the atmosphere in the furnace can be quickly decreased to a level suitable for normal operation, before performing normal operation of continuously heat-treating a steel strip after opening the vertical annealing furnace to the air, or when the water concentration and/or the oxygen concentration in the atmosphere in the furnace increases during normal operation. The disclosed technique not only has the advantageous effect of lowering the dew point, but also is beneficial in terms of operation efficiency in the case where the atmosphere in the furnace needs to be replaced upon changing the steel type or the like.

DETAILED DESCRIPTION

The following describes an embodiment of the disclosed steel strip continuous annealing device (apparatus) and continuous hot-dip galvanising device (apparatus).

Figure 1:
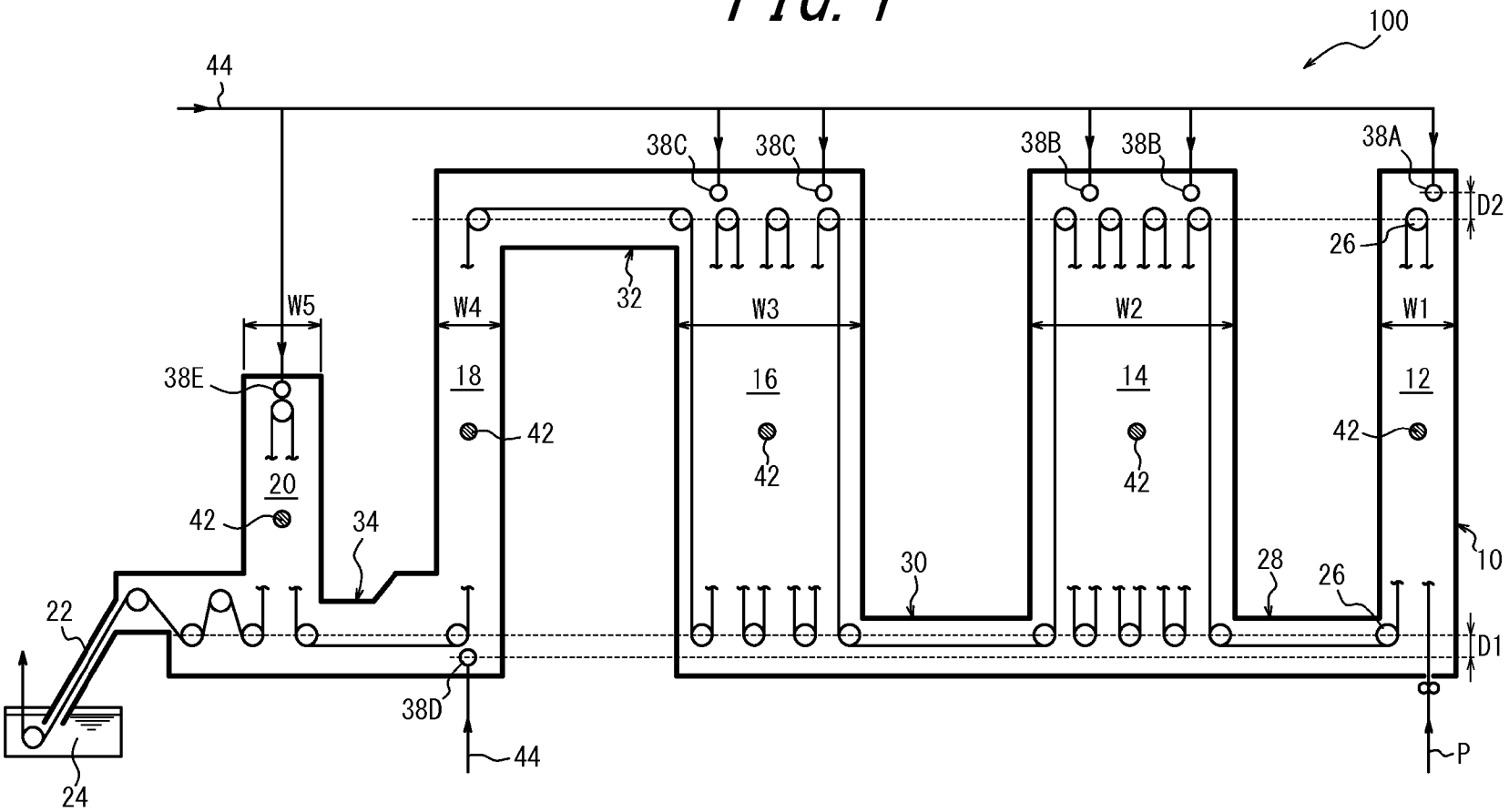
FIG. 1 is a schematic diagram illustrating the structure of a continuous hot-dip galvanising device 100 in an embodiment.

As illustrated in FIG. 1, a steel strip continuous annealing device in this embodiment has a vertical annealing furnace 10 in which a preheating zone 12, a heating zone 14, a soaking zone 16, and cooling zones 18 and 20 are arranged in this order from upstream to downstream. The cooling zone in this embodiment is composed of the first cooling zone 18 and the second cooling zone 20. The continuous annealing device anneals a steel strip P. One or more hearth rolls 26 are placed in upper and lower parts in each of the zones 12, 14, 16, 18, and 20. The steel strip P is folded back by 180 degrees at each hearth roll 26 to be conveyed up and down a plurality of times in the vertical annealing furnace 10, thus forming a plurality of passes. While FIG. 1 illustrates an example of having 2 passes in the preheating zone 12, 8 passes in the heating zone 14, 7 passes in the soaking zone 16, 1 pass in the first cooling zone 18, and 2 passes in the second cooling zone 20, the numbers of passes are not limited to such, and may be set as appropriate according to the processing condition. At some of the hearth rolls 26, the steel strip P is not folded back but changed in direction at the right angle to move to the next zone. The steel strip P thus passes through the zones 12, 14, 16, 18, and 20 in this order. Note that the preheating zone 12 may be omitted. A snout 22 linked to the second cooling zone 20 connects the vertical annealing furnace 10 to a molten bath 24 as a hot-dip galvanising device.

A continuous hot-dip galvanising device 100 in this embodiment includes the above-mentioned continuous annealing device and the molten bath 24 for hot-dip galvanising the steel strip P discharged from the second cooling zone 20.

The inside of the vertical annealing furnace 10 from the preheating zone 12 to the snout 22 is kept in a reductive atmosphere or a non-oxidizing atmosphere. In the preheating zone 12, the steel strip P is introduced from an opening (steel strip introduction portion) formed in its lower part, and heated by gas that has been heat-exchanged with combustion exhaust gas of the below-mentioned RT burner. In the heating zone 14 and the soaking zone 16, the steel strip P can be indirectly heated using a radiant tube (RT) (not illustrated) as heating means. The soaking zone 16 may be provided with a vertically extending partition wall (not illustrated) so as to leave an upper opening, within the range that does not impede the advantageous effects of the disclosure. After the steel strip P is heated for annealing to a predetermined temperature in the heating zone 14 and the soaking zone 16, the steel strip P is cooled in the first cooling zone 18 and the second cooling zone 20, and then immersed in the molten bath 24 through the snout 22 to be hot-dip galvanised. The galvanised coating may then be subjected to alloying treatment.

In the vertical annealing furnace 10, adjacent zones communicate with each other through a communicating portion that connects the upper parts or lower parts of the respective zones. In this embodiment, the preheating zone 12 and the heating zone 14 communicate through a throat (restriction portion) 28 as a communicating portion that connects the lower parts of the respective zones, the heating zone 14 and the soaking zone 16 communicate through a throat 30 as a communicating portion that connects the lower parts of the respective zones, the soaking zone 16 and the first cooling zone 18 communicate through a throat 32 as a communicating portion that connects the upper parts of the respective zones, and the first cooling zone 18 and the second cooling zone 20 communicate through a throat 34 as a communicating portion that connects the lower parts of the respective zones. The height of each of the communicating portions 28, 30, 32, and 34 may be set as appropriate. Given that the diameter of each hearth roll 26 is about 1 m, the height of each of the communicating portions 28, 30, 32, and 34 is preferably greater than or equal to 1.5 m. Note, however, that the height of each communicating portion is preferably as low as possible in terms of enhancing the independence of the atmosphere in each zone.

As reducing gas or non-oxidizing gas introduced into the vertical annealing furnace 10, $H_2$—$N_2$ mixed gas is typically used. An example is gas (dew point: about −60° C.) having a composition in which $H_2$ content is 1% to 10% by volume with the balance being $N_2$ and incidental impurities. The gas is introduced from gas delivery ports 38A, 38B, 38C, 38D, and 38E respectively provided in the zones 12, 14, 16, 18, and 20 as illustrated in FIG. 1 (hereafter reference sign 38 is also used for reference signs 38A to 38E collectively). The gas is supplied to these gas delivery ports 38 from a gas supply system 44 schematically illustrated in FIG. 1. The gas supply system 44 includes valves and flowmeters (not illustrated) as appropriate, to regulate or stop the gas supply to each gas delivery port 38 individually.

The continuous hot-dip galvanising device 100 in this embodiment has a characteristic structure in which the position of the gas delivery port 38 in each zone is opposite in the vertical direction to the position of the communicating portion with the immediately preceding zone in the order in which the steel strip P passes through, i.e. the immediately upstream zone. In detail, the gas delivery port 38B in the heating zone 14 is provided in the upper part of the heating zone 14, because the communicating portion 28 is positioned in the lower part. The gas delivery port 38C in the soaking zone 16 is provided in the upper part of the soaking zone 16, because the communicating portion 30 is positioned in the lower part. The gas delivery port 38D in the first cooling zone 18 is provided in the lower part of the first cooling zone 18, because the communicating portion 32 is positioned in the upper part. The gas delivery port 38E in the second cooling zone 20 is provided in the upper part of the second cooling zone 20, because the communicating portion 34 is positioned in the lower part. The preheating zone 12 is the most upstream zone and does not have a communicating portion on its upstream side. In this embodiment, the gas delivery port 38A in the preheating zone 12 is provided in the upper part of the preheating zone 12.

Figure 3:
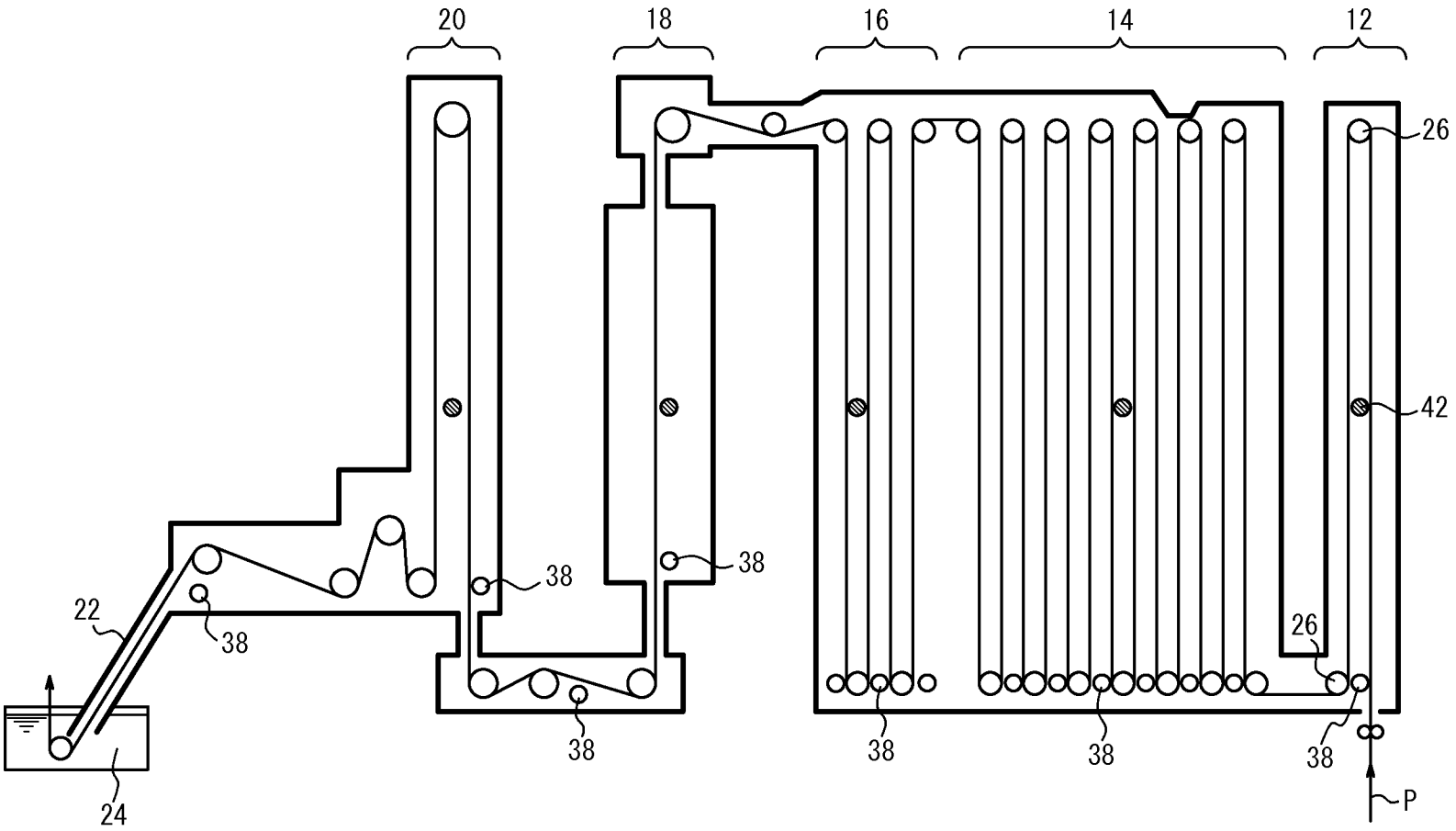
FIG. 3 is a schematic diagram illustrating the structure of a conventional continuous hot-dip galvanising device.

To identify the technical significance of the disclosure, an example of a conventional continuous hot-dip galvanising device is described below, with reference to FIG. 3. In FIG. 3, the same structural parts as those in the device in FIG. 1 are given the same reference signs. The continuous hot-dip galvanising device in FIG. 3 has a vertical annealing furnace in which a preheating zone 12, a heating zone 14, a soaking zone 16, and cooling zones 18 and 20 are arranged in this order and that is connected to a molten bath 24 through a snout 22. The heating zone 14 and the soaking zone 16 are integrated with each other. Gas is introduced into the furnace from gas delivery ports 38 provided in the lower parts of the zones 12 to 20 and the connecting portion between the cooling zones 18 and 20. The vertical annealing furnace has no gas discharge port. In such a continuous hot-dip galvanising device, the vertical annealing furnace is connected to the molten bath 24 through the snout 22. Accordingly, the gas introduced in the furnace is typically discharged from the furnace entrance side, i.e. the opening as the steel strip introduction portion in the lower part of the preheating zone 12, except for inevitable phenomenon such as leakage from the furnace, and the gas in the furnace flows from downstream to upstream in the furnace, which is opposite to the steel strip travel direction (from right to left in FIG. 3). With this structure, the gas does not uniformly spread in the furnace but stagnates in various parts in the furnace, so that the atmosphere in the furnace cannot be switched quickly.

According to the disclosure, on the other hand, the gas delivery port 38 in the preheating zone 12 is provided in the upper part, and the gas delivery port 38 in each of the other zones 14, 16, 18, and 20 is provided in the position opposite in the vertical direction to the position of the communicating portion with the immediately upstream zone. The gas in the furnace tends to flow toward the furnace entrance side, as mentioned above. Hence, the gas introduced into each of the zones 14, 16, 18, and 20 from the corresponding one of the gas delivery ports 38B, 38C, 38D, and 38E mostly flows through the zone toward the connecting portion 28, 30, 32, or 34 with the immediately upstream zone (toward the furnace entrance side). Moreover, the gas introduced into the preheating zone 12 from the gas delivery port 38A flows through the preheating zone 12 toward its lower part.

With this structure, the gas spreads uniformly in the furnace, and gas stagnation is sufficiently suppressed. As a result, the atmosphere in the furnace can be switched quickly. Thus, the dew point of the atmosphere in the furnace can be quickly decreased to a level suitable for normal operation, before performing normal operation of continuously heat-treating a steel strip after opening the vertical annealing furnace to the air, or when the water concentration and/or the oxygen concentration in the atmosphere in the furnace increases during normal operation.

In this embodiment, it is preferable to provide the gas delivery port 38A of the preheating zone 12 only in the upper part of the preheating zone 12, and the gas delivery port of each of the other zones 14, 16, 18, and 20 only in the position opposite in the vertical direction to the position of the communicating portion with the immediately upstream zone.

In the case where the preheating zone 12 is omitted, the heating zone 14 is the most upstream zone, and the opening as the steel strip introduction portion is formed in the lower part of the heating zone 14. The gas delivery port 38B is accordingly provided in the upper part, regardless of the relationship with the communicating portion. This structure has the same working effects as above. In this case, too, it is preferable to provide the gas delivery port 38B of the heating zone 14 only in the upper part of the heating zone 14, and the gas delivery port of each of the other zones 16, 18, and 20 only in the position opposite in the vertical direction to the position of the communicating portion with the immediately upstream zone.

In this description, "the upper part of each zone" denotes the area that is 25% of the height of the zone from the upper end of the zone, and "the lower part of each zone" denotes the area that is 25% of the height of the zone from the lower end of the zone.

Figure 2:
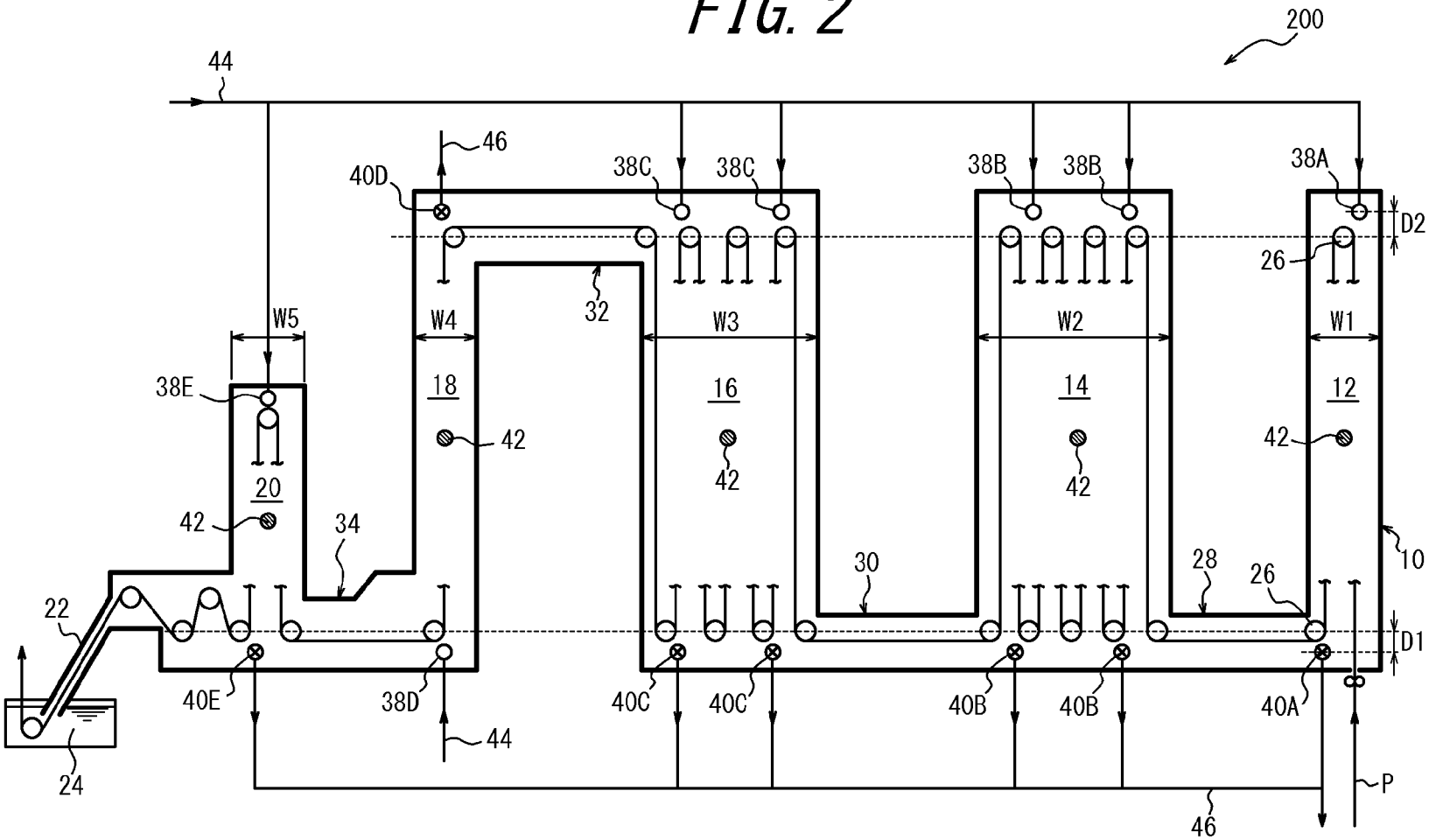
FIG. 2 is a schematic diagram illustrating the structure of a continuous hot-dip galvanising device 200 in another embodiment.

FIG. 2 illustrates the structure of a continuous hot-dip galvanising device 200 in another embodiment. This device 200 has gas discharge ports 40A, 40B, 40C, 40D, and 40E (hereafter reference sign 40 is also used for reference signs 40A to 40E collectively) for discharging furnace gas which has high water vapor or oxygen content and is high in dew point from the vertical annealing furnace 10, in the respective zones. The position of the gas discharge port 40 in each zone is opposite in the vertical direction to the position of the gas delivery port 38 in the zone, as illustrated in FIG. 2. A gas discharge system 46 schematically illustrated in FIG. 2 is connected to a suction device, and includes valves and flowmeters as appropriate to regulate or stop the gas discharge from each gas discharge port 40 individually. The other structures are the same as those of the continuous hot-dip galvanising device 100 in FIG. 1, and so their description is omitted.

With this structure, for example, the gas introduced from the gas delivery port 38C of the soaking zone 16, after passing through the soaking zone 16, is mostly discharged from the gas discharge port 40C of the soaking zone 16 without flowing toward the upstream heating zone 14 through the communicating portion 30. The same applies to the other zones. In other words, the atmosphere in each zone can be independently controlled by sufficiently preventing the atmosphere gas from flowing to the other zones, so that the atmosphere in the furnace can be switched more quickly. The structure of providing both the gas delivery port and the gas discharge port in each zone as in this embodiment is very preferable because independent atmosphere control in each zone can be achieved.

The gas discharge port 40 does not necessarily need to be provided in all zones, and may be provided only in zones where independent atmosphere control is highly required, e.g. the heating zone 14, the soaking zone 16, and the first cooling zone 18. To enhance the advantageous effects of the disclosure, however, the gas discharge port 40 is preferably provided in all zones as illustrated in FIG. 2. Here, it is preferable to provide the gas discharge port 40 in each zone only in the position opposite in the vertical direction to the position of the gas delivery port 38.

Since the internal pressure in each zone is usually 200 Pa to 400 Pa higher than atmospheric pressure, the gas in the furnace can be discharged even without the suction device. For discharge efficiency, however, it is preferable to provide the suction device. The gas discharged from the gas discharge port 40 includes flammable gas, and so is burned by a burner. For energy efficiency, the heat generated here is preferably used for gas heating in the preheating zone 12.

To independently control the atmosphere in each zone, an atmosphere separation portion for separating the atmospheres in the adjacent zones from each other is preferably provided in all communicating portions 28, 30, 32, and 34. This sufficiently prevents the gas in each of the zones 12, 14, 16, 18, and 20 from diffusing to its adjacent zone.

As the atmosphere separation portion, a partition plate (not illustrated) may be placed in each of the connecting portions 28, 30, 32, and 34. A seal roll or a damper may be placed instead of the partition plate. Alternatively, a gas-type separation device may be provided in the connecting portion to realize separation by an air curtain formed by seal gas such as $N_2$. These structures may be used in combination. To enhance the atmosphere separation, one or more types of separation members mentioned above are preferably provided in the connecting portions 28, 30, 32, and 34 as throats. The necessary degree of atmosphere separation is determined depending on the desired dew point, and the structure of the atmosphere separation portion can be designed as appropriate according to the degree of atmosphere separation.

The communicating portions 28, 30, 32, and 34 may be positioned in any of the upper part and lower part of the furnace. Preferably, the communicating portion 28 between the preheating zone 12 and the heating zone 14 and the communicating portion 30 between the heating zone 14 and the soaking zone 16 each connect the lower parts of the zones, as in this embodiment. This is because the independence of the atmosphere in each of the preheating zone 12, the heating zone 14, and the soaking zone 16 can be enhanced by connecting the high-temperature atmosphere zones in the lower part. On the other hand, the communicating portion 32 between the soaking zone 16 and the first cooling zone 18 preferably connects the upper parts of the zones 16 and 18, to suppress gas mixture. This is because, since the first cooling zone 18 is lower in temperature than the soaking zone 16, there is a possibility that the gas in the first cooling zone 18 having a high specific gravity enters into the soaking zone 16 in large quantity in the case where the connecting portion 32 is provided in the lower part of the furnace. Meanwhile, the connection between the cooling zones has no constraint in terms of atmosphere control, and so the connecting portion 34 between the first cooling zone 18 and the second cooling zone 20 may be conveniently positioned according to the necessary number of passes.

Each of the lengths W1, W2, W3, W4, and W5 of the respective zones 12, 14, 16, 18, and 20 is preferably less than or equal to 7 m. For example, in the case where two gas delivery ports 38 are provided in each zone, W1 to W5 are each preferably less than or equal to 7 m in order to effectively form gas flow in the zone. While gas flow can be formed to a certain extent if three or more gas delivery ports 38 are provided, gas inevitably flows in the horizontal direction of the furnace. Accordingly, for atmosphere separation in each zone, W1 to W5 are each preferably less than or equal to 7 m. In the case where one gas delivery port 38 is provided, on the other hand, W1 to W5 are each preferably less than or equal to 4 m.

The flow rate Q per gas delivery port 38 in each zone is preferably high in terms of atmosphere switching efficiency. The flow rate Q is preferably set as follows. The flow rate Q ($m^3$/hr) preferably satisfies $Q>2.62\times V$, where V ($m^3$) is the volume of the zone per gas delivery port. For example, in the case where V=200 $m^3$, the flow rate Q preferably exceeds 524 $m^3$/hr. Here, it is preferable to set the upper limit to less than or equal to 3930 $m^3$/hr in terms of cost.

Moreover, the flow rate Q ($m^3$/hr) per gas delivery port 38 in each zone preferably satisfies $Q>0.87\times V_0$, where $V_0$ ($m^3$) is the volume of the zone regardless of the number of gas delivery ports.

Note that such a flow rate Q ($m^3$/hr) is a value converted on an assumption that the atmospheric temperature in the furnace is 800° C.

The flow rate per gas discharge port 40 in each zone may be set as appropriate based on the above-mentioned flow rate Q.

In the case where the gas discharge port 40 is provided in each of the zones 12, 14, 16, 18, and 20, the number of gas delivery ports 38 and the number of gas discharge ports 40 are preferably the same in each zone so that the gas delivery ports 38 and the gas discharge ports 40 in the upper and lower parts of the furnace are paired with each other, for efficient atmosphere switching.

The disclosed continuous annealing device and continuous hot-dip galvanising device are capable of quickly switching the atmosphere in the furnace, and accordingly not only have the advantageous effect of lowering the dew point but also are beneficial in terms of operation efficiency in the case where the atmosphere in the furnace needs to be replaced upon changing the steel type or the like. For example, in the case of manufacturing a high tensile strength material in a high dew point atmosphere, the inside of the furnace needs to be switched from a low dew point atmosphere to a high dew point atmosphere. The disclosed continuous annealing device can perform such atmosphere switching quickly. In addition, the disclosed continuous annealing device is capable of individually controlling hydrogen in each zone, so that hydrogen can be concentrated in a necessary zone. For example, concentrating hydrogen in the cooling zone contributes to a higher cooling capacity, and concentrating hydrogen in the soaking zone contributes to a higher $H_2/H_2O$ ratio, with it being possible to improve the coating property of the high tensile strength material and the like and the heating efficiency. Furthermore, for example in the case of introducing ammonia in a specific part for nitriding treatment, the introduction can be efficiently performed by changing hydrogen to ammonia.

The disclosure relates to facility configurations, and exhibits significantly advantageous effects when applied at the time of construction rather than modification to existing facilities. New facilities to which this disclosure is applied can be constructed substantially at the same cost as conventional facilities.

EXAMPLES

The following describes a dew point measurement test performed using the continuous hot-dip galvanising devices illustrated in FIGS. 1 and 2 according to the disclosure and the continuous hot-dip galvanising device illustrated in FIG. 3 as Comparative Example.

Example 1

The ART (all radiant) CGL device illustrated in FIG. 1, the overall structure of which has been described above, has the following specific structure. The distance between the upper and lower hearth rolls is 20 m (10 m in the second cooling zone). The volume $V_0$ of each zone and the volume V of each zone per gas delivery port are as indicated in Table 1. The zone length is 1.5 m in the preheating zone, 6.8 m in the heating zone, 6.0 m in the soaking zone, 1.0 m in the first cooling zone, and 1.5 m in the second cooling zone. The gas delivery port has a diameter of 50 mm. The center of the gas delivery port in the first cooling zone is located 1 m below the center of the lower hearth roll in the furnace (D1=1 m in FIG. 1). The center of the gas delivery port in the other zones is located 1 m above the center of the upper hearth roll in the furnace (D2=1 m in FIG. 1). The dew point of the gas delivered from the gas delivery port is −70° C. to −60° C., and the flow rate Q per gas delivery port in each zone is as indicated in Table 1. A dew point meter is placed in a center part (position 42 in FIG. 1) in each zone.

Example 2

The ART (all radiant) CGL device illustrated in FIG. 2, the overall structure of which has been described above, has the following specific structure. The device has the same structure as the device in FIG. 1, except that the gas discharge port is provided in each zone as illustrated in FIG. 2. The gas discharge port has a diameter of 50 mm. The center of the gas discharge port in the first cooling zone is located 1 m above the center of the upper hearth roll in the furnace (D2=1 m in FIG. 2). The center of the gas discharge port in the other zones is located 1 m below the center of the lower hearth roll in the furnace (D1=1 m in FIG. 2). The discharge flow rate from the gas discharge port in each zone is the same as the delivery flow rate from the corresponding gas delivery port. A dew point meter is placed in a center part (position 42 in FIG. 2) in each zone.

Comparative Example

The ART (all radiant) CGL device illustrated in FIG. 3, the overall structure of which has been described above, has the following specific structure. The distance between the upper and lower hearth rolls is 20 m. The zone volume is 80 $m^3$ in the preheating zone, 840 $m^3$ in the combination of the heating zone and the soaking zone, 65 $m^3$ in the first cooling zone, and 65 $m^3$ in the second cooling zone. Each gas delivery port is disposed in the position illustrated in FIG. 3, and has a diameter of 50 mm. The dew point of the gas delivered from the gas delivery port is −70° C. to −60° C., and the total delivery rate of the gas from all gas delivery ports is 3930 $Nm^3$/hr. The delivery flow rate per port is the same. A dew point meter is placed in a center part (position 42 in FIG. 3) in each zone.

Figure 4A:
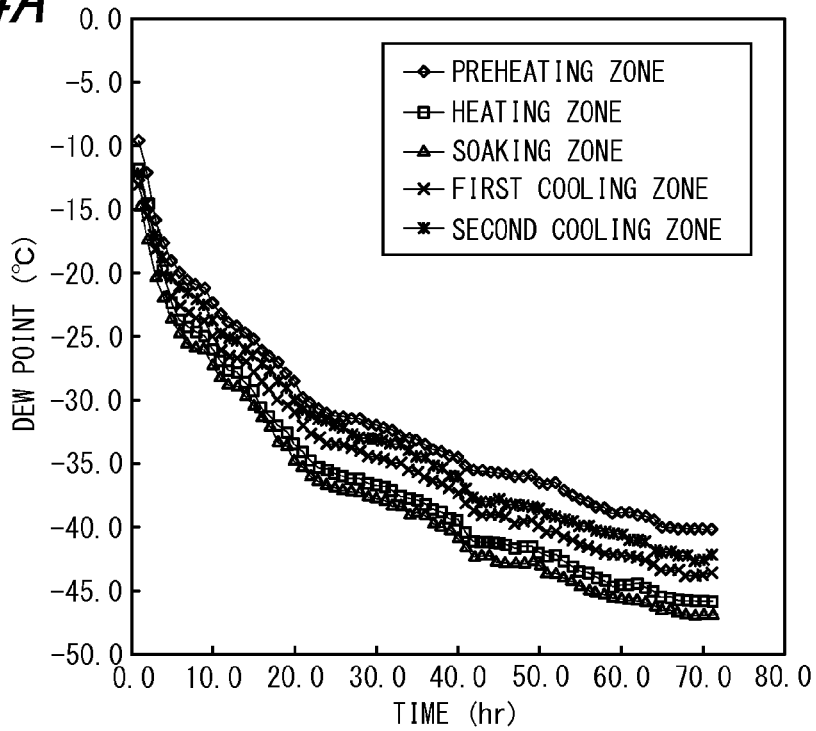
FIG. 4A is a graph illustrating the temporal changes of the dew point in a vertical annealing furnace in Example 1.
Figure 4B:
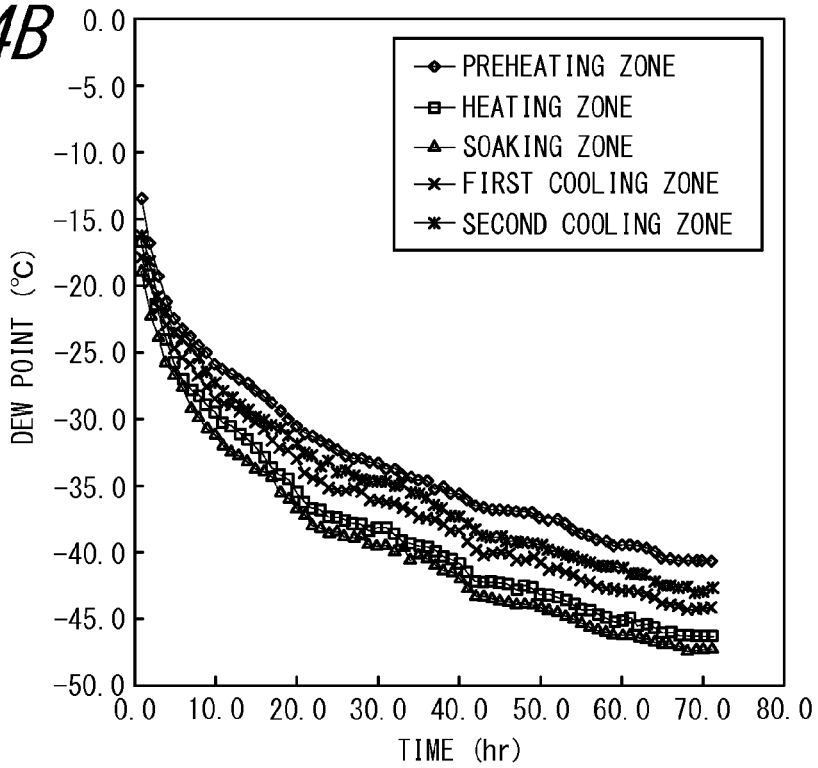
FIG. 4B is a graph illustrating the temporal changes of the dew point in a vertical annealing furnace in Example 2.
Figure 5:
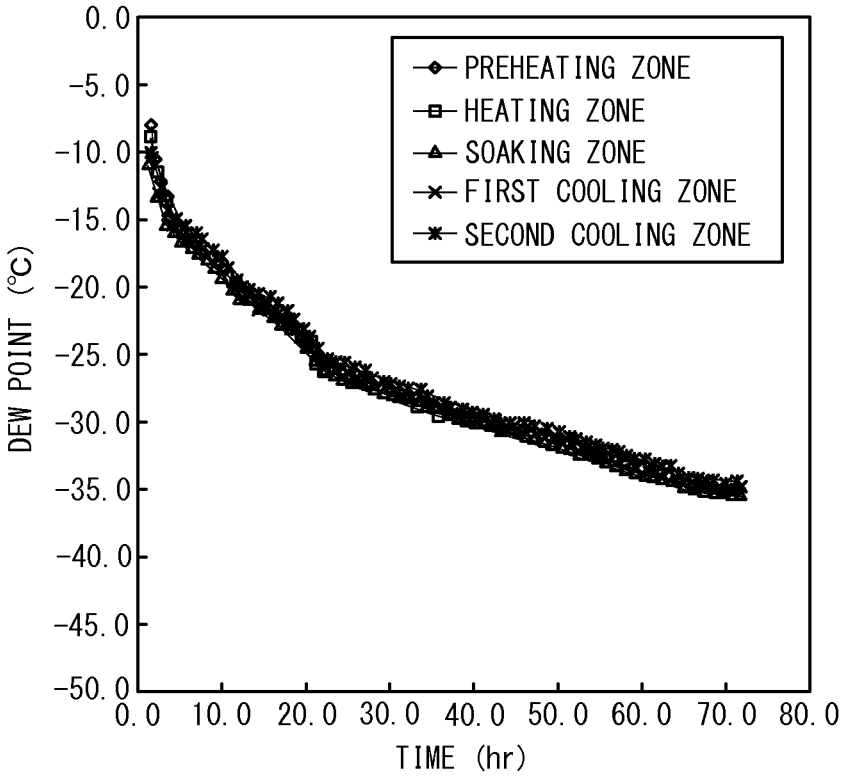
FIG. 5 is a graph illustrating the temporal changes of the dew point in a vertical annealing furnace in Comparative Example.

In the continuous hot-dip galvanising devices of Examples 1 and 2 and Comparative Example, upon startup after opening the vertical annealing furnace to the air, atmospheric gas containing water vapor or oxygen of about −10° C. was present in the furnace (see 0 hr in FIGS. 4A, 4B, and 5). Operation was then started in the following conditions. The size of the steel strip is 900 mm to 1100 mm in width and 0.8 mm to 1.0 mm in sheet thickness, and the steel type is as indicated in Table 2. The sheet passing speed is 100 mpm to 120 mpm (except immediately after line start), and the annealing temperature is 780° C. to 820° C.

In Example 1 in FIG. 1 and Comparative Example in FIG. 3 having no gas discharge ports, the gas in the furnace was discharged only from the entrance side of the vertical annealing furnace. In Example 2 in FIG. 2 having gas discharge ports, the gas in each zone did not flow into the other zones and independent atmosphere control was possible.

TABLE 1

| | Pre-heating zone | Heating zone | Soaking zone | First cooling zone | Second cooling zone |
|---|---|---|---|---|---|
| $V_0$ ($m^3$) | 80 | 375 | 330 | 55 | 35 |
| Number of gas delivery ports | 1 | 2 | 2 | 1 | 1 |
| V ($m^3$) | 80 | 187.5 | 165 | 55 | 35 |
| Right side of Expression (1) 2.62 × V | 209.6 | 491.25 | 432.3 | 144.1 | 91.7 |
| Right side of Expression (2) 0.87 × $V_0$ | 69.6 | 326.25 | 287.1 | 47.85 | 30.45 |
| Q ($m^3$/hr) | 209.6 | 491.25 | 432.3 | 144.1 | 91.7 |

TABLE 2

| C | Si | Mn | S | (mass %) Al |
|---|---|---|---|---|
| 0.12 | 0.5 | 1.7 | 0.003 | 0.03 |

The temporal changes of the dew point in each zone in the vertical annealing furnace from the operation start in Example 1, Example 2, and Comparative Example are illustrated respectively in FIGS. 4A, 4B, and 5. In Comparative Example, about 40 hours were needed for the dew point to fall below −30° C., as illustrated in FIG. 5. In Example 1, on the other hand, the dew point reached −30° C. in about 20 hours in all zones, as illustrated in FIG. 4A. Particularly in the soaking zone which is important in manufacture of high tensile strength materials, the dew point reached −30° C. in 15 hours. In Example 2, the dew point reached −30° C. in 20 hours in all zones, and the dew point in the soaking zone reached −30° C. in 8 hours, as illustrated in FIG. 4B. Thus, Example 2 exhibited the advantageous effect of lowering the dew point more quickly than Example 1.

The dew point reached after 70 hours was near −35° C. in Comparative Example, but lower in all locations in Examples 1 and 2. Particularly in the soaking zone, the dew point decreased to less than or equal to −45° C., creating a state suitable for manufacture of high tensile strength materials.

For efficient atmosphere switching, it is important to suppress stagnation of gas flow in the furnace. We studied the suitable length of each zone for this purpose, using a flow analysis method (computational fluid dynamics (CFD)). Gas delivery ports were arranged in an upper part (position of 0.5 m from the top) of a rectangular parallelepiped (variable in length, 20 m in height, and 2.5 m in depth), and gas discharge ports were arranged in a lower part (position of 0.5 m from the bottom) of the rectangular parallelepiped. The number of pairs of delivery and discharge ports was 1 per meter of the length of the rectangular parallelepiped, the diameter was 50 mm, and the flow rate at each gas delivery port was 100 $m^3$/hr. Flow analysis was conducted in this condition, to evaluate the time until all flow lines were sucked to the gas discharge ports from inside the rectangular parallelepiped. Note that the number of flow lines was 100 lines/$m^3$, k−ϵ model was used as a random number model, and the energy term was not taken into account.

Figure 6:
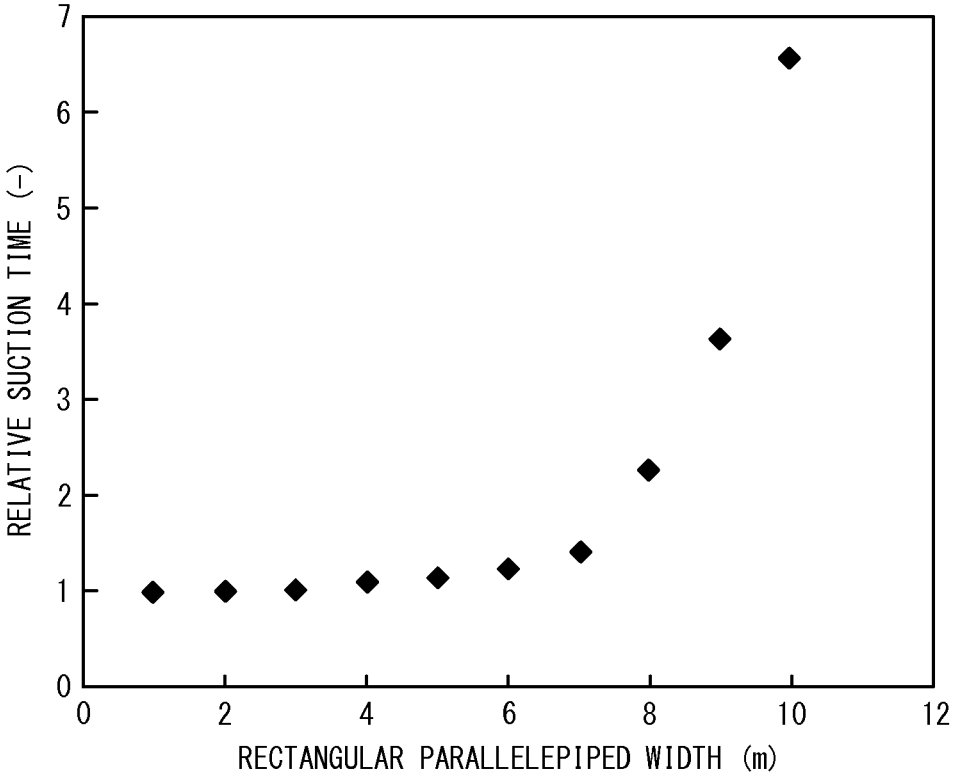
FIG. 6 is a graph illustrating the relationship between the rectangular parallelepiped width and the relative suction time according to flow analysis.

FIG. 6 illustrates the flow analysis result. As can be understood from FIG. 6, in the case where the length of the rectangular parallelepiped is less than or equal to 7 m, the suction time is approximately at a minimum, and effective atmosphere switching is possible. This demonstrates that gas stagnation can be effectively suppressed by limiting the length of the rectangular parallelepiped to less than or equal to the predetermined length to limit the degree of freedom of gas movement.

INDUSTRIAL APPLICABILITY

It is possible to provide a steel strip continuous annealing device and continuous hot-dip galvanising device capable of quickly switching the atmosphere in a furnace.

REFERENCE SIGNS LIST

100, 200 continuous hot-dip galvanising device
10 vertical annealing furnace
12 preheating zone
14 heating zone
16 soaking zone
18 first cooling zone
20 second cooling zone
22 snout
24 molten bath (hot-dip galvanising device)
26 hearth roll
28, 30, 32, 34 communicating portion (throat)
38A to 38E gas delivery port
40A to 40E gas discharge port
42 dew point measurement position
44 gas supply system
46 gas discharge system
P steel strip

The invention claimed is:

1. A steel strip continuous annealing device that has a vertical annealing furnace in which a heating zone, a soaking zone, and a cooling zone are arranged in the stated order, and anneals a steel strip passing through the zones in the order while being conveyed in a vertical direction in the vertical annealing furnace, wherein adjacent zones communicate with each other through a communicating portion that connects upper parts or lower parts of the respective zones, a communicating portion between the heating zone and the soaking zone connects lower parts of the respective zones, and a communicating portion between the soaking zone and the cooling zone connects upper parts of the respective zones, a gas delivery port is provided in each of the heating zone, the soaking zone, and the cooling zone, and the gas delivery port in the heating zone is provided only in an upper part of the heating zone, and the gas delivery port in each of the soaking zone and the cooling zone is provided only in a position opposite in the vertical direction to a position of a communicating portion with an immediately preceding zone in the order in which the steel strip passes through.

2. The steel strip continuous annealing device according to claim 1, wherein a preheating zone provided with a gas delivery port in an upper part is arranged upstream of the heating zone, and the preheating zone and the heating zone communicate with each other through a communicating portion that connects upper parts or lower parts of the respective zones, and the gas delivery port in the heating zone is provided in a position opposite in the vertical direction to a position of the communicating portion with the preheating zone, instead of in the upper part of the heating zone.

3. The steel strip continuous annealing device according to claim 1, wherein the communicating portion between the preheating zone and the heating zone connects the lower parts of the respective zones.

4. The steel strip continuous annealing device according to claim 1, wherein a gas discharge port is provided in a part or all of the zones, in a position opposite in the vertical direction to a position of the gas delivery port.

5. The steel strip continuous annealing device according to claim 1, wherein a length of each of the zones is 7 m or less.

6. The steel strip continuous annealing device according to claim 1, wherein an atmosphere separation portion for separating atmospheres in adjacent zones from each other is provided in each communicating portion.

7. The steel strip continuous annealing device according to claim 1, wherein a flow rate Q ($m^3$/hr) per gas delivery port in each zone satisfies conditions of Expression (1) and Expression (2)

$$Q>2.62\times V \quad \text{Expression (1)}$$

$$Q>0.87\times V_0 \quad \text{Expression (2)}$$

where $V_0$ ($m^3$) is a volume of the zone, and V ($m^3$) is a volume of the zone per gas delivery port.

8. A continuous hot-dip galvanising device comprising:

the steel strip continuous annealing device according to claim 1; and a hot-dip galvanising device that hot-dip galvanises the steel strip discharged from the cooling zone.

9. The steel strip continuous annealing device according to claim 1, wherein a gas discharge port is provided in each of the zones, in a position opposite in the vertical direction to a position of the gas delivery port.

* * * * *